US005218376A

United States Patent [19]

Asai

[11] Patent Number: 5,218,376

[45] Date of Patent: Jun. 8, 1993

[54] LIQUID JET METHOD, RECORDING HEAD USING THE METHOD AND RECORDING APPARATUS USING THE METHOD

[75] Inventor: Akira Asai, Atsugi, Japan

[73] Assignee: Canon Kabushiki Kaisha, Tokyo, Japan

[21] Appl. No.: 692,943

[22] Filed: Apr. 29, 1991

[30] Foreign Application Priority Data

Apr. 28, 1990 [JP] Japan ..... 2-114472

[51] Int. Cl.[5] ..... B41J 2/05

[52] U.S. Cl. ..... 346/1.1; 346/140 R

[58] Field of Search ..... 346/1.1, 140 R

[56] References Cited

U.S. PATENT DOCUMENTS 4,723,129 2/1988 Endo ..... 346/1.1

FOREIGN PATENT DOCUMENTS 0118640 9/1984 European Pat. Off. .
0124192 11/1984 European Pat. Off. .
55-59975 5/1980 Japan .
55-132270 10/1980 Japan .
55-132276 10/1980 Japan .
55-154171 12/1980 Japan .
56-46769 4/1981 Japan .
58-1571 1/1983 Japan .
60-236758 11/1985 Japan .
61-40160 2/1986 Japan .
62-104764 5/1987 Japan .

*Primary Examiner*—Joseph W. Hartary
*Attorney, Agent, or Firm*—Fitzpatrick, Cella, Harper & Scinto

[57] ABSTRACT

A liquid jet method for ejecting liquid using a bubble created by heating the liquid in a passage, characterized in that a non-dimensional number Z which is determined by the nature of the liquid, a heat flux and a configuration of the passage and which is specific to a recording head is not less than 0.5 and not more than 16; where $$Z=(\pi/6)^{1/2}Tgk(p_g/q_0)^{3/2}/(\rho_g Lg\cdot a\cdot S_H A)^{1/2};$$

Tg is a superheat limit temperature of the major component of the liquid;

Pg is a saturated vapor pressure of the major component of the liquid at temperature Tg;

$\rho g$ is a saturated vapor density of the major component of the liquid at temperature Tg;

Lg is a latent image of vaporization of the major component of the liquid at temperature Tg;

k is a heat conductivity of the major component of the liquid at the temperature of the recording head before heating;

a is a thermal diffusivity of the major component of the liquid at the temperature of the recording head before heating;

$q_0$ is a flux of the heat which heats the liquid;

$S_H$ is an area of that part (heating surface of the heat generating element) which heats the liquid;

A is an inertance of the passage under the conditions that the heating surface is a pressure source, that the liquid supply opening and the liquid ejection opening are open boundaries, and that the wall defining the passage is a wall (fixed) boundary;

$\pi$ is the number $\pi$;

W is the work done by a bubble on the liquid, and

Q is the heat applied from the heat generating element to the liquid from the start of the heating to the creation of the bubble.

6 Claims, 9 Drawing Sheets

FIG. 2(a)
FIG. 2(b)
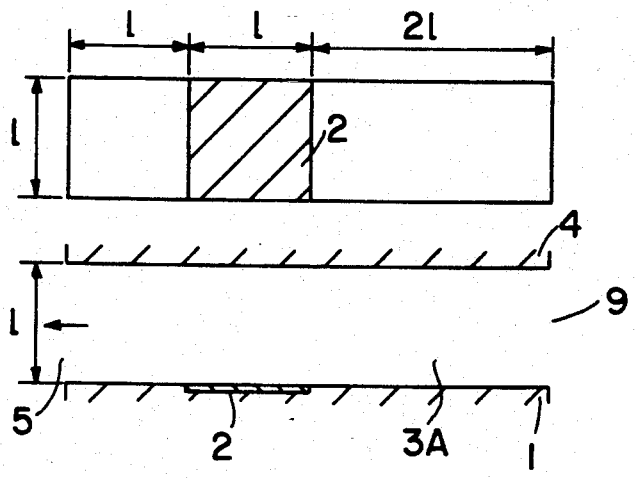
FIG. 3
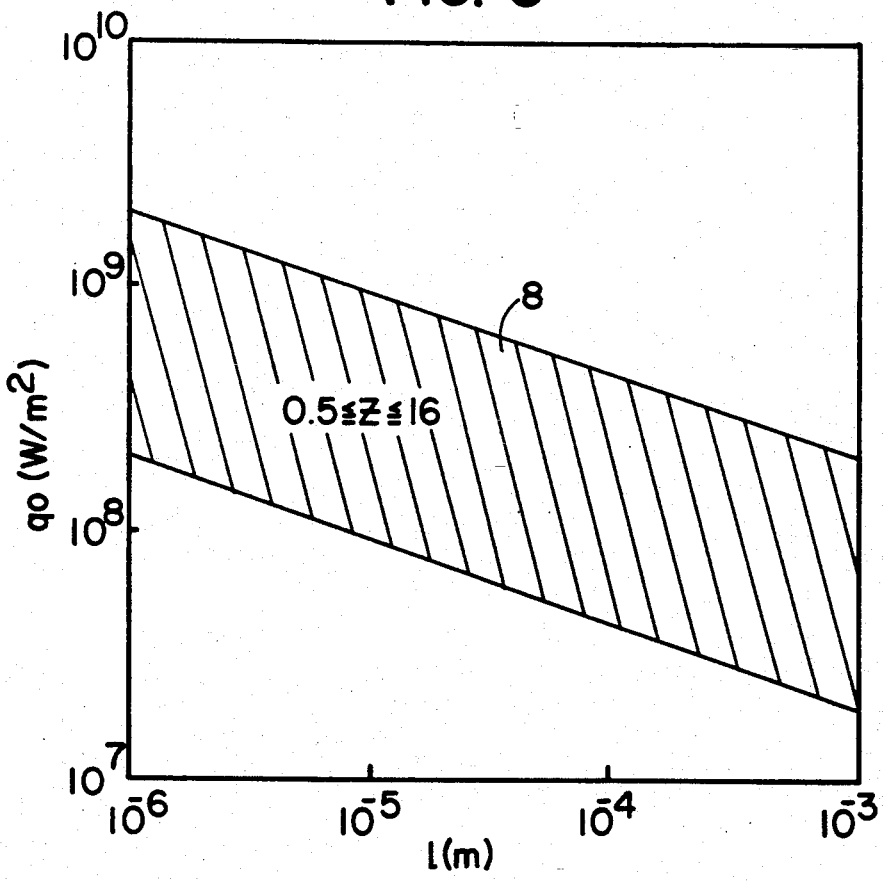

FIG. 4(a)
FIG. 4(b)
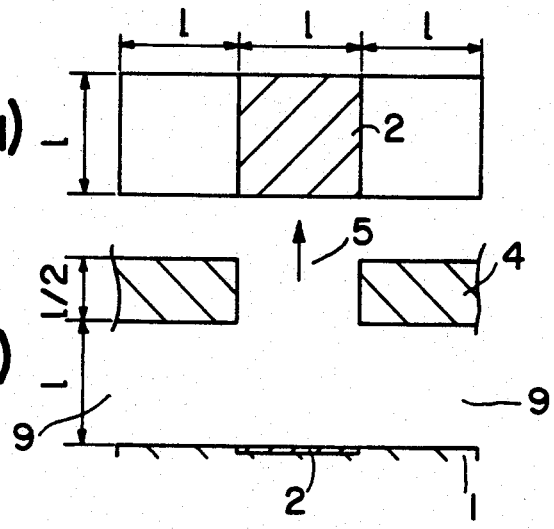
FIG. 5
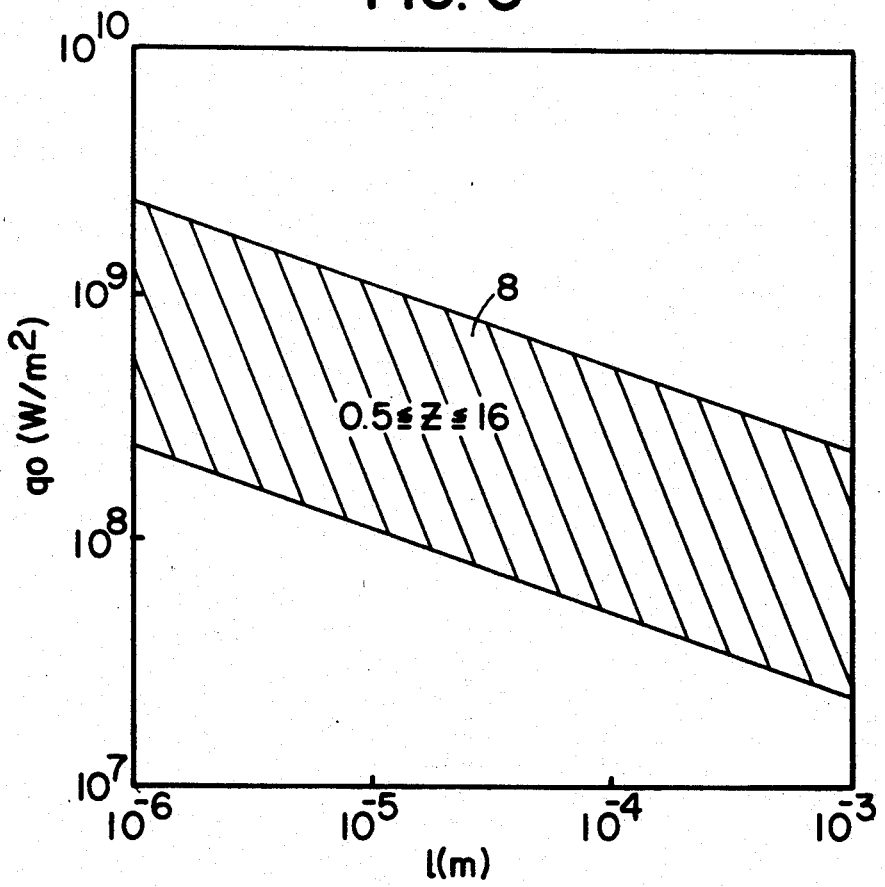

LIQUID JET METHOD, RECORDING HEAD USING THE METHOD AND RECORDING APPARATUS USING THE METHOD

FIELD OF THE INVENTION AND RELATED ART

The present invention relates to a liquid jet method, a recording head using the method and a recording apparatus using the method wherein liquid in a passage is heated and evaporated.

As for the liquid jet method wherein the liquid is heated to produce a high pressure to eject the liquid, the following is known.

Japanese Laid-Open Patent Application No. 59975/1980 discloses an apparatus wherein a liquid supply direction and a liquid ejecting direction forms an angle of approximately 90 degrees, by which an ejection efficiency, a speed of response of the ejection, the stability of ejection and long term recording performance are improved.

Japanese Laid-Open Patent Application No. 132270/1980 discloses an apparatus wherein a heat generating element is disposed remote from an ejection outlet having a diameter d by d−50d, so that a thermal efficiency, a speed of response of the liquid droplet ejection and the ejection stability are improved.

Japanese Laid-Open Patent Application No. 132276/1980 discloses an apparatus wherein dimensions and a position of the heat generating element and the length of the liquid passage are so selected as to satisfy a predetermined relationship, by which an energy efficiency is improved, and good recording operation is carried out at a high speed.

Japanese Laid-Open Patent Application No. 154171/1980 discloses an apparatus wherein an upper layer, a heat generating resistor layer and a lower layer of the heat generating element have thicknesses satisfying a predetermined relationship, so that the thermal energy acts efficiently on the liquid, and that the thermal response is improved.

Japanese Laid-Open Patent Application No. 46769/1981 discloses a recording head wherein the liquid passage and the heat generating element satisfy predetermined positional and dimensional relationship, by which the energy is efficiently consumed for the ejection of the liquid droplet, so that the liquid droplet is stably formed.

Japanese Laid-Open Patent Application No. 1571/1983 discloses a recording method wherein a driving voltage is 1.02–1.3 times the minimum bubble creation voltage, so that the quality of the recorded image is improved with stability.

Japanese Laid-Open Patent Application No. 236758/1985 discloses a recording head wherein an upper protection layer of the heat generating element is made thinner than the other protection layer, by which the loss of the thermal energy is reduced, and the durability is improved.

Japanese Laid-Open Patent Application No. 40160/1986 discloses a recording head wherein a resistance material is disposed in the vicinity of the heat generating element, the resistance material having different coefficients of resistance depending on the direction of the flow of the liquid, by which the heat acting portions can be disposed at high density, and that the practical reliability is improved.

Japanese Laid-Open Patent Application No. 104764/1987 discloses a recording method wherein a heating pulsewidth is limited within a predetermined range determined on the basis of the structure of the heat generating element, by which the liquid droplets can be ejected efficiently and with low energy.

However, in the conventional method and apparatus, the attention has been paid only to the heat transfer efficiency from the heat generating element to the liquid and the energy efficiency in the liquid motion in the liquid passage, and no attention has been directed to the efficiency of conversion of the heat to the kinetic energy of the liquid.

Therefore, the prior art involves a problem that even if the heat transfer efficiency and the energy efficiency of the fluid motion are good, the total energy efficiency is low, since the efficiency of the energy conversion from the heat to the fluid motion is low.

For example, even if a certain recording head has a good energy efficiency, the energy efficiency is lowered if the dimension or dimensions of the liquid passage is modified. This may be because of the lowering of the efficiency of the conversion from the heat to the energy of the fluid motion.

On the other hand, the efficiency of the conversion of the heat to the fluid motion energy in a reversible heat engine is $(1-T2/T1)$, where T1 is the absolute temperature of a high temperature source, and T2 is the absolute temperature of a low temperature source, as is well-known. Since, however, the process of evaporating the liquid and ejecting the liquid by the high pressure resulting from the evaporation is an extremely irreversible process, the law of the reversible process does not apply.

SUMMARY OF THE INVENTION

Accordingly, it is a principal object of the present invention to provide a liquid jet method, a recording head using the method and a recording apparatus using the method wherein the efficiency is improved.

It is another object of the present invention to provide a liquid jet method, a recording head using the method and a recording apparatus using the method wherein a total energy efficiency is improved.

It is a further object of the present invention to provide a liquid jet method, a recording head using the method and a recording apparatus using the method wherein the efficiency of conversion from heat to kinetic energy of the liquid is improved.

According to an aspect of the present invention, there is provided a liquid jet method for ejecting liquid using a bubble created by heating the liquid in a passage, characterized in that a non-dimensional number Z which is determined by the nature of the liquid, a heat flux and a configuration of the passage and which is specific to a recording head is not less than 0.5 and not more than 16; where $$Z=(\pi/6)^{\frac{1}{2}}Tgk(p_g/q_0)^{3/2}/(\rho_g Lg\cdot a\cdot S_H A)^{\frac{1}{2}};$$

Tg is a superheat limit temperature of the major component of the liquid;

Pg is a saturated vapor pressure of the major component of the liquid at temperature Tg;

$\rho g$ is a saturated vapor density of the major component of the liquid at temperature Tg;

Lg is a latent heat of vaporization of the major component of the liquid at temperature Tg;

k is a heat conductivity of the major component of the liquid at the temperature of the recording head before heating;

a is a thermal diffusivity of the major component of the liquid at the temperature of the recording head before heating;

$q_0$ is a flux of the heat which heats the liquid;

$S_H$ is an area of that part (heating surface of the heat generating element) which heats the liquid;

A is an inertance of the passage under the conditions that the heating surface is a pressure source, that the liquid supply opening and the liquid ejection opening are open boundaries, and that the wall defining the passage is a wall (fixed) boundary;

$\pi$ is the number $\pi$;

W is the work done by a bubble on the liquid, and

Q is the heat applied from the heat generating element to the liquid from the start of the heating to the creation of the bubble.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 shows a structure of a recording head according to a first embodiment of the present invention.

FIG. 3 is a graph showing an optimum design condition in the first embodiment.

FIG. 4 shows a structure of a recording head according to a second embodiment of the present invention.

FIG. 5 shows an optimum design condition in the second embodiment.

DESCRIPTION OF THE PREFERRED EMBODIMENTS

Figure 1:
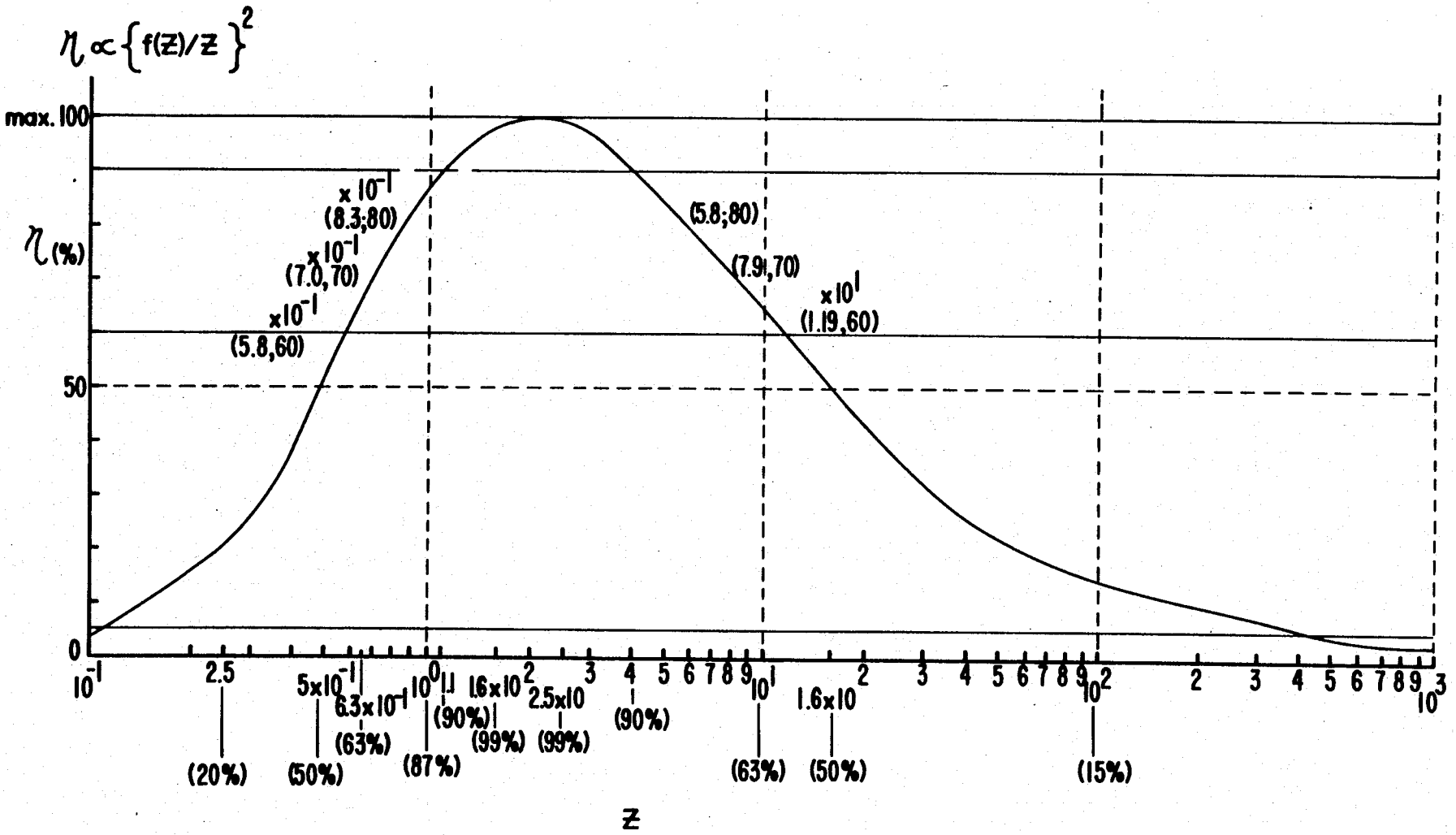
FIG. 1 is a graph showing a relation between a non-dimensional number Z and a thermal efficiency to illustrate the fundamental concept of the present invention.

Recent investigations have revealed that there is a general relation as shown in FIG. 1 between a non-dimensional number Z specific to a recording head $$Z=(\pi/6)^{\frac{1}{2}}Tgk(Pg/q_0)^{3/2}/(\rho gLg\cdot a\cdot S_HA)^{\frac{1}{2}}$$

and an efficiency $\eta=W/Q$, where

Tg is a superheat limit temperature of the major component of the liquid;

Pg is a saturated vapor pressure of the major component of the liquid at temperature Tg;

$\rho g$ is a saturated vapor density of the major component of the liquid at temperature Tg;

Lg is a latent heat of vaporization of the major component of the liquid at temperature Tg;

k is a heat conductivity of the major component of the liquid at the temperature of the recording head before heating;

a is a thermal diffusivity of the major component of the liquid at the temperature of the recording head before heating;

$q_0$ is a flux of the heat which heats the liquid;

$S_H$ is an area of that part (heating surface of the heat generating element) which heats the liquid;

A is an inertance of the passage under the conditions that the heating surface is a pressure source, that the liquid supply opening and the liquid ejection opening are open boundaries, and that the wall defining the passage is a wall (fixed) boundary;

$\pi$ is the number $\pi$;

W is the work done by a bubble on the liquid, and

Q is the heat applied from the heat generating element to the liquid from the start of the heating to the creation of the bubble.

As will be understood from FIG. 1, the thermal efficiency $\eta$ is not less than 50% of its maximum if $0.5 \leqq Z \leqq 16$. Accordingly, $0.5 \leqq Z \leqq 16$ is desirable for the good thermal efficiency.

The description will be made as to how the relation shown in FIG. 1 is derived.

(1) Bubble Creation Temperature

When the liquid is heated with a high heat flux, the temperature at which the liquid starts to boil is far higher than the normal boiling temperature and is close to the super heat limit temperature Tg of the liquid.

This is because under the normal boiling conditions, the air or vapor trapped by the heating surface functions as nucleuses, whereas under the high heat flux heating, spontaneous nucleus generation due to the molecular motion of the liquid is the major cause of the boiling action.

The super heat limit temperature Tg of the liquid is determined as the temperature T satisfying:

$$\tau V\cdot(N_A\rho/m)\cdot(3N_A\sigma(T)/\pi m)^{\frac{1}{2}}\exp[-(16\pi\sigma^3(T)/3(p_s(T)-p_{amb})^2k_BT]=1 \quad (1)$$

$\tau$ is a heating period of time;

V is a volume of the liquid heated during the period $\tau$ ($\approx 2\sqrt{a\pi}\cdot S_H$);

$N_A$ is the Avogadro number;

m is a molecular weight of the liquid;

p is a density of the liquid;

$k_B$ is the Boltzmaun's constant;

$p_{amb}$ is the standard atmospheric pressure:

$\sigma(T)$ and $p_s(T)$ are a surface tension and vapor pressure at the saturated state at temperature T.

(2) Change of Bubble Volume Vv with Time

Immediately after the bubble creation, the speed of the fluid is small, and therefore, the convention and viscosity terms are negligible.

Then, $$\begin{cases} V\cdot u = 0 \\ \rho(\partial\vec{u}/\partial t) + Vp = 0 \end{cases} \quad (2)$$

where $\vec{u}$ is the vector of the fluid speed, and p is pressure field.

Let the pressure of the bubble be $p_v$. Because the boundary of the bubble is substantially equal to the heating surface immediately after the bubble creation, $$\begin{cases} \nabla^2 p = o \\ p = p_v, \text{ on } S_H \\ p = p_{amb}, \text{ on } S_{amb} \end{cases} \quad (3)$$

Then, $$\begin{cases} p = p_{amb} + (p_v - p_{amb})\Phi \\ \vec{u} = -(\nabla\Phi/\rho)\int_0^t (p_v - p_{amb})dt \end{cases} \quad (4)$$

where $S_H$ is (an area of) the heating surface, $S_{amb}$ is an open boundary such as a liquid inlet opening or a liquid outlet opening, and $\Phi$ is a function determined solely by configuration of the liquid passage and is defined as a solution of;

$$\nabla^2\Phi=0$$

$$\Phi=1, \text{ on } S_H$$

$$\Phi=0, \text{ on } S_{amb}$$

$$\nabla\Phi\cdot\vec{n}=0, \text{ on passage wall} \quad (5)$$

The volume of the bubble Vv satisfies the following, immediately after the bubble creation. Therefore, $$dVv/dt = \int_{SH} \vec{u}\cdot\vec{n}dS_H \quad (6)$$

Then, $$p_v - p_{amb} = -\left(\rho/\int_{SH} \nabla\Phi\cdot\vec{n}dS_H\right)\cdot(d^2Vv/dt^2) \quad (7)$$

where $\vec{n}$ is a vector of normal lines from the heating surface to the liquid.

Equation (7) is integrated with the following initial condition:

$$Vv=0, \text{ at } t=0$$

$$dVv/dt=0, \text{ at } t=0 \quad (8)$$

Then, the volume change immediately after the bubble formation is given by $$dVv/dt = 1/A\cdot\int_0^t (p_v - p_{amb})dt \quad (9)$$

$$Vv = \int_0^t (dVv/dt)dt$$

where A is an inertance of the passage when the heating surface is the source of pressure, and the supply inlet opening and ejection outlet opening are open boundaries, and is given by $$A - \rho/\int_{SH} \nabla\Phi\cdot\vec{n}dS_H \quad (10)$$

Immediately after the bubble creation, $$p_v \approx p_g \quad (11)$$

Since $p_g >> p_{amb}$, the following results from equation (9):

$$dVv/dt=p_g t/A$$

$$Vv=p_g t^2/2A \quad (12)$$

(3) Change of Bubble Temperature Tv with Time

If the heating is stopped simultaneously with the creation of the bubble, the enthalpy change of the system immediately after the bubble creation is given by the first law of thermodynamics:

$$dH/dt=S_H q_v(t)+Vv(dp_v/dt) \quad (13)$$

where $q_v(t)$ is the heat flux extending from the liquid to the bubble.

Immediately after the bubble creation, $$dH/dt \approx Lg\rho g(dVv/dt) \quad (14)$$

Noting that the first term of the right side of Equation (13) is negligibly small as compared with the first term, the following results from Equation (13):

$$q_v(t)=(p_g\rho_g L_g/S_H A)t \quad (15)$$

If it is shortly after the bubble creation, if the heating period is short and if the temperature distribution in the liquid is one-dimensional in the direction perpendicular to the heating surface, the following results from Equation (15):

$$Tv = Tamb + (2q_0/k)\sqrt{a(t_0+t)/\pi} - 2/k[q_0 + (2p_g\rho_g Lg/3S_H A)t]\sqrt{at/\pi} \quad (16)$$

where $t_0$ is the time from the start of the heating to the creation of the bubble and is given by:

$$t_0=(\pi/4a)\cdot[(Tg-Tamb)^2k^2/q_0^2] \quad (17)$$

From Equations (16) and (17), the temperature change immediately after the bubble creation is $$\begin{aligned} Tv &\approx Tg - (2/k)[q_0 + 2p_g\rho_g Lg/3S_H A)t]\sqrt{at/\pi} \\ &= Tg[1 - \alpha_g\beta_g(1 + t/tx)\sqrt{t/ty} \end{aligned} \quad (18)$$

$$tx = 3q_0 S_H A/2p_g\rho_g Lg$$
$$ty = (\alpha_g\beta_g Tgk)^2/4\,q_0^2 a$$

(4) Change of Bubble Pressure with Time

Equation of Clausius-Clapeyson is $$dp_v/dTv=Lv/Tv(1\rho_v-1/\rho_l) \quad (19)$$

This is integrated from temperature Tg to temperature Tv with the following conditions:

$$p_v=\rho_v GTv$$

$$[\rho_l/(\rho_l-\rho_v)]Lv \approx [\rho_l/(\rho_l-\rho_g)]Lg \quad (20)$$

Then, $$p_v \approx p_g \exp\,[1/\alpha_g\beta_g(1-Tg/Tv)] \quad (21)$$

where G is the gas constant, Lv, $\rho_v$ and $\rho_l$ are the latent evaporation heat, the density of the vapor and the density of the liquid at the saturated state at temperature Tv, and $$\begin{cases} \alpha_g \equiv 1 - \rho_g/\rho \\ \beta_g = p_g/\rho_g Lg \end{cases} \quad (22)$$

Since the second term is smaller than the first term in the right side of Equation (18) immediately after the bubble creation, the substitution of Equation (18) into Equation (21) results $$p_v \approx p_g \exp\,[-1(1 + t/tx)\sqrt{t/ty} \quad (23)$$

From this, the time period (time constant) $t_e$ until $p_v$ becomes $p_g(1/e)$ $$t_e = t_x f(\sqrt{ty/tx}\,) \quad (24)$$

where f(Z) is the root of the following algebraic equation with the parameter Z:

$$1 + f = Z/\sqrt{f} \quad (25)$$

(5) Thermal Efficiency

Most of the work W by the bubble on the liquid is done when the pressure is high immediately after the bubble creation, and therefore, $p_v >> p_{amb}$ in equation (9).

Then, $$W \approx P^2/2A \quad (26)$$

where P is the impulse by the pressure $p_v$ and is given by $$p \propto p_g t_e \quad (27)$$

On the other hand, the heat Q given before the bubble creation is:

$$\begin{aligned} Q &= S_H q_0 t_0 \\ &= \pi\,(Tg - Tamb)^2 k^2 S_H/4aq_0 \end{aligned} \quad (28)$$

Therefore, the efficiency $\eta$, when the bubble is deemed as a heat engine, is $$\begin{aligned} \eta &= W/Q \\ &\propto (3/4)\alpha_g^2\beta_g^3[Tg/(Tg - Tamb)]^2 \cdot [f(z)/Z]^2 \end{aligned} \quad (29)$$

where, $$\begin{aligned} Z &= \sqrt{ty/tx} \\ &= (\pi/6)^{1/2} Tgk\,(p_g/p_0)^{3/2} \cdot 1/\,(\rho_g Lg \cdot a \cdot S_H A)^{1/2} \end{aligned} \quad (30)$$

FIG. 1 is plots of $\eta$ as a function of Z obtained from Equation (29).

Embodiment 1

The consideration will be made as to the designing of the ink jet recording head as shown in FIG. 2. The region is divided into meshes of cubes having a size of 1/20. Equation (5) is solved using a finite element method.

Then, $$A = 0.97\rho/l$$

Since, $$S_H = l^2$$

then, $$Z = (\pi/6)^{\frac{1}{2}} Tgk(p_g^3/\rho_g L_g a\rho)^{\frac{1}{2}} \cdot (1/1.3q_0^3 l)^{\frac{1}{2}}$$

In order to satisfy $0.5 \leqq Z \leqq 16$, $$\pi/6 \cdot (Tg \cdot k)^2/0.97 \times 16^2 \cdot p_g^3/\rho_g L_g a\rho \leqq q_0^3 l \leqq \pi/6 \cdot (Tg \cdot k)^2/0.97 \times 0.5^2 \cdot p_g^3/\rho_g L_g a\rho$$

In water type ink as the liquid, $Tg \approx 600$ K., $p_g \approx 1.2 \times 10^7\ Pa$ $\rho_g \approx 0.073 \times 10^3\ kg/m^3$, $L_g \approx 1.2 \times 10^6\ J/Kg$, $k \approx 6.1 \times 10^{-1}\ W/(m\ k)$, $a \approx 1.5 \times 10^{-7}\ m^2/S$, $\rho \approx 1.0 \times 10^3\ Kg/m^3$.

In order to satisfy $0.5 \leqq Z \leqq 16$, $$9.3 \times 10^{18}\ W^3/m^5 \leqq q_0^3 l \leqq 9.5 \times 10^{21}\ W^3/m^5$$

This is expressed as the hatched region in FIG. 3.

Embodiment 2

The consideration will be made as to the designing of the ink jet recording head as shown in FIG. 4. The region is divided into meshes of cubes having a size of 1/20. Equation (5) is solved using a finite element method.

Then, $$A = 0.63\rho/l$$

Similarly to Embodiment 1, in order to satisfy $0.5 \leqq Z \leqq 16$ when the ink is water type, $$1.4 \times 10^{19}\ W^3/m^5 \leqq q_0^3 l \leqq 1.5 \times 10^{22}\ W^3/m^5$$

This is expressed as the hatched region in FIG. 5.

Referring back to FIG. 1, the non-dimensional number Z will be described in further detail. It is preferable that the thermal efficiency is not less than 60% of the maximum efficiency, since then the design error can be accommodated practically. This is satisfied if the non-dimensional number Z is not less than 0.58 and not more than 11.7, as will be understood from FIG. 1. If this is satisfied, the yield in the liquid jet head manufacturing is improved, and the liquid jet performance is assured from all of the liquid passages when plural liquid passages are connected to common liquid chamber. In addition, the manufacturing is possible without the necessity for the complicated recovery process or shading. In other words, the yield can be remarkably increased, and the recording performance can be stabilized. Furthermore, if the thermal efficiency is not less than 70% of the maximum (max), in other words, if the non-dimensional number Z is not less than 0.70 and not more than 7.9, the thermal efficiency is further increased so that the high frequency driving which has been difficult to put into practice can be accomplished. The advantages are further improved, if it is not less than 80% (the non-dimensional number Z is not less than 0.83 and not more than 5.8); if it is not less than 90% (the non-dimensional number Z is not less than 1.1 and not more than 4.0); particularly if it is not less than 99% (the non-dimensional number Z is not less than 1.6 and not more than 2.5).

The present invention is usable with any of conventional liquid jet method wherein a bubble is created from liquid (including the liquid which becomes liquid upon the liquid ejection) using thermal energy. However, the present invention is particularly advantageously used with the system wherein a semi-pillow bubble is formed by causing an abrupt temperature rise to a temperature exceeding nucleate boiling temperature and causing film boiling by the heating surface.

The present invention is also advantageously used with the liquid jet system which will be described hereinafter and which has been proposed in the patent application assigned to the assignee of this application, since the advantageous effects of the present invention are further enhanced.

FIGS. 6(*a*), 6(*b*), 6(*c*), 6(*d*) and 6(*e*) are graphs of bubble internal pressure vs. volume change with time in a first specific liquid jet method and apparatus according to a first specific embodiment of the present invention.

This aspect of the present invention is summarized as follows:

(1) A liquid jet method wherein a bubble is produced by heating ink to eject at least a part of the ink by the bubble, and wherein the bubble communicates with the ambience under the condition that the internal pressure of the bubble is not higher than the ambient pressure.

(2) A recording apparatus including a recording head having an ejection outlet through which at least a part of ink is discharged by a bubble produced by heating the ink by an ejection energy generating means, a driving circuit for driving the ejection energy generating means so that the bubble communicates with the ambience under the condition that the internal pressure of the bubble is not more than the ambient pressure, and a platen for supporting a recording material to face the ejection outlet.

According to the specific embodiment of the present invention, the volume and the speed of the discharged liquid droplets are affected, so that the splash or mist which is attributable to the incapability of sufficiently high speed record can be suppressed. The contamination of the background of images can be prevented. When the present invention is embodied as an apparatus, the contamination of the apparatus can be prevented. The ejection efficiency is improved. The clogging of the ejection outlet or the passage can be prevented. The service life of the recording head is expanded with high quality of the print.

Referring to FIG. 7, the principle of liquid ejection will be described, before FIGS. 6A–6D are described. The liquid passage is constituted by a base 1, a top plate 4 and unshown walls.

FIG. 7(*a*) shows the initial state in which the passage is filled with ink 3. The heater 2 (electro-thermal transducer, for example) is instantaneously supplied with electric current, the ink adjacent the heater 2 is abruptly heated by the pulse of the current, upon which a bubble 6 is produced on the heater 2 by the so-called film boiling, and the bubble abruptly expands (FIG. 7(*b*)). The bubble continues to expand toward the ejection outlet 5, that is, in the direction of low intertia resistance. It further expands beyond the outlet 5 so that it communicates with the ambience (FIG. 7(*c*)). At this time, the ambience is in equilibrium with the inside of the bubble 6, or it enters the bubble 6.

The ink 3 pushed out by the bubble through the outlet 5 moves forward further by the momentum given by the expansion of the bubble, until it becomes an independent droplet and is deposited on a recording material 101 such as paper (FIG. 7, (*d*)). The cavity produced adjacent the outlet 5 is supplied with the ink from behind by the surface tension of the ink 3 and by the wetting with the member defining the liquid passage, thus restoring the initial state (FIG. 7, (*e*)). The recording medium 101 is fed to the position faced to the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required in the relative movement therebetween is to face the outlet to a desired position of the recording material.

In FIG. 7, (*c*), in order that the gas does not move between the bubble 6 and the ambience, or the ambient gas or gases enter the bubble, at the time when the bubble 6 communicates with the ambience, it is desirable that the bubble communicates with the ambience under the condition that the pressure of the bubble is equal to or lower than the ambient pressure.

In order to satisfy the above, the bubble is made to communicate with the ambience in the period satisfying $t \geqq t1$ in FIG. 6, (*a*). Actually, however, the relation between the bubble internal pressure and the bubble volume with the time is as shown in FIG. 6, (*b*), because the ink is ejected by the expansion of the bubble. Thus, the bubble is made to communicate with the ambience in the time satisfying $t = tb$ ($t1 \leqq tb$) in FIG. 6, (*c*).

The ejection of the droplet under this condition is preferable to the ejection with the bubble internal pressure higher than the ambient pressure (the gas ejects into the ambience), in that the contamination of the recording paper or the inside of the apparatus due to the ink mist or splash. Additionally, the ink acquires sufficient energy, and therefore, a higher ejection speed, because the bubble communicates with the ambience only after the volume of the bubble increases.

In addition, it is further preferable to let the bubble communicate with the ambience under the condition that the bubble internal pressure is lower than the external pressure, since the above-described advantages are further enhanced.

The lower pressure communication is effective to prevent the unstabilized liquid adjacent the outlet from splashing which otherwise is liable to occur. In addition, it is advantageous in that the force, if not large, is applied to the unstabilized liquid in the backward direction, by which the liquid ejection is further stabilized, and the unnecessary liquid splash can be suppressed.

In a first specific embodiment, the recording head has the heater 2 adjacent to the outlet 5. This is the easy arrangement to make the bubble communicate with the ambience. However, the above-described preferable condition is not satisfied by simply making the heater 2 close to the outlet. The proper selections are made to satisfy it with respect to the amount of the thermal energy (the structure, material, driving conditions, area or the like of the heater, the thermal capacity of a member supporting the heater, or the like), the nature of the ink, the various sizes of the recording head (the distance between the ejection outlet and the heater, the widths and heights of the outlet and the liquid passage).

As a parameter for effectively embodying the first specific embodiment, there is a configuration of the liquid passage, as described hereinbefore. The width of the liquid passage is substantially determined by the configuration of the used thermal energy generating element, but it is determined on the basis of rule of thumb. However, it has been found that the configuration of the liquid passage is significantly influential to growth of the bubble, and that it is an effective factor.

It has been found that the communicating condition can be controlled by changing the height of the liquid passage. To be less vulnerable to the ambient condition or the like and to be more stable, it is desirable that the height of the liquid passage is smaller than the width thereof ($H<W$).

It is also desirable that the communication between the bubble and the ambience occurs when the bubble volume is not less than 70%, further preferably, not less than 80% of the maximum volume of the bubble or the maximum volume which will be reached before the bubble communicates with the ambience.

The description will be made as to the method of measuring the relation between the bubble internal pressure and the ambient pressure.

It is difficult to directly measure the pressure in the bubble and therefore, the pressure relation between them is determined in one or more of the following manners.

First, the description will be made as to the method of determining the relation between the internal pressure and the ambient pressure on the basis of the measurements of the change, with time, of the bubble volume and the volume of the ink outside the outlet.

The volume V of the bubble is measured from the start of the bubble creation to the communication thereof with the ambience. Then, the second order differential $d^2V/dt^2$ is calculated, by which the relation (which is larger) between the internal pressure and the ambient pressure is known, because if $d^2V/dt^2>0$, the internal pressure of the bubble is higher than the external pressure, and if $d^2V/dt^2\leqq 0$, the internal pressure is equal to or less than the external pressure. Referring to FIG. 6, (*c*), from the time $t=t_0$ to the time $t=t_1$, the internal pressure is higher than the external pressure, and $d^2V/dt^2>0$; from the time $t=t_1$ to the time $t=t_b$ (occurrence of communication), the internal pressure is equal to or less than the ambient pressure, and $d^2V/dt^2\leqq 0$. Thus, by determining the second order differential of the volume V, ($d^2V/dt^2$), the higher one of the internal and external pressure is determined.

Here, it is required that the bubble can be observed directly or indirectly from the outside. In order to permit observance of the bubble externally, a part of the recording head is made of transparent material. Then, the creation, development or the like of the bubble is observed from the outside. If the recording head is formed of non-transparent material, a top plate or the like of the recording head may be replaced with a transparent plate. For better replacement from the standpoint of equivalency, the hardness, elasticity and the like of the materials are selected to be as close as possible with each other.

If the top plate of the recording head is made of metal, non-transparent ceramic material or colored ceramic material, it may be replaced with a transparent plastic resin material (transparent acrylic resin material) plate, glass plate or the like. The part of recording head to be replaced and the material to replace the part are not limited to that described above.

In order to avoid difference in the nature of the bubble formation or the like due to the difference in the nature of the materials, the material to replace preferably has the wetting nature relative to the ink or another nature which is as close as possible to that of original material. Whether the bubble creation is the same or not may be confirmed by comparing the ejection speeds, the volume of ejected liquid or the like before and after the replacement. If a suitable part of the recording head is made of transparent material, the replacement is not required.

Even if any suitable part cannot be replaced with another material, it is possible to determine which of the internal pressure and the external pressure is larger, without the replacement. This method will be described.

Figure 6A:
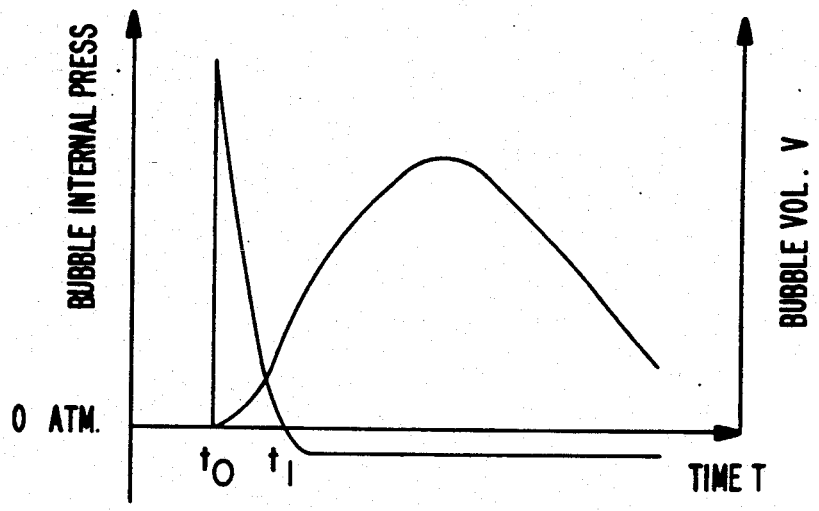
FIGS. 6A, 6B, 6C, 6D and 6E illustrate changes with time of the internal pressure and volume of a bubble in a liquid jet method according to an aspect of the present invention.
Figure 6B:
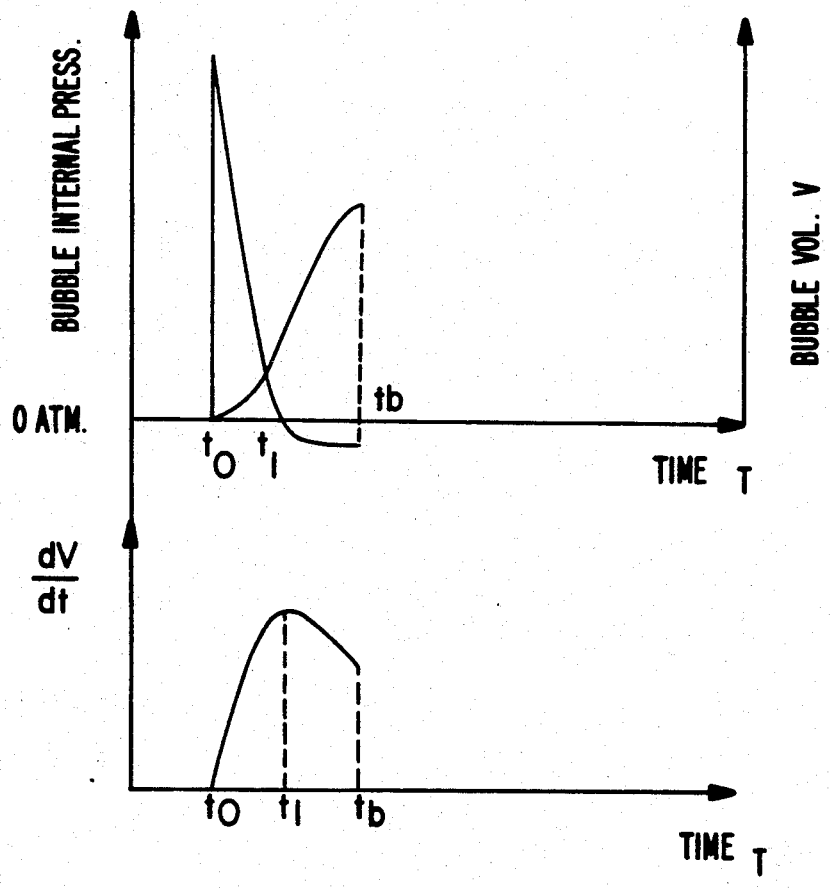
Figure 6C:
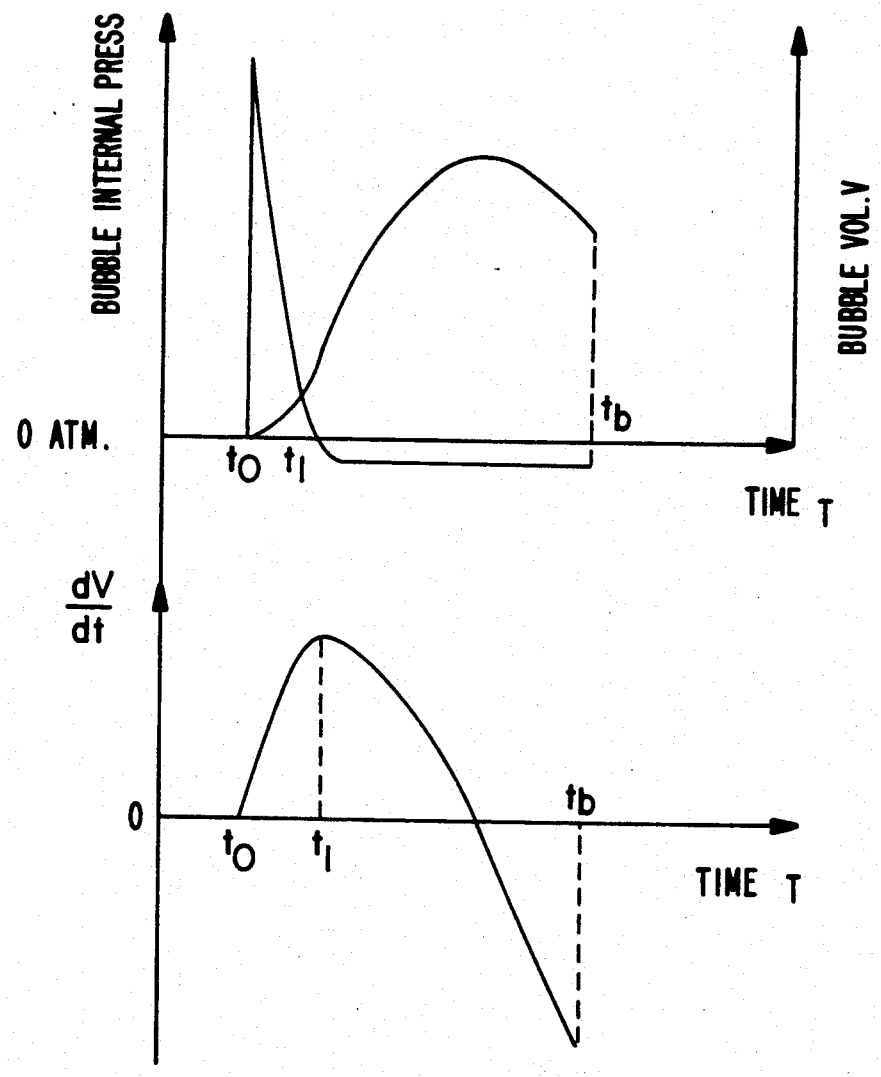
Figure 6D:
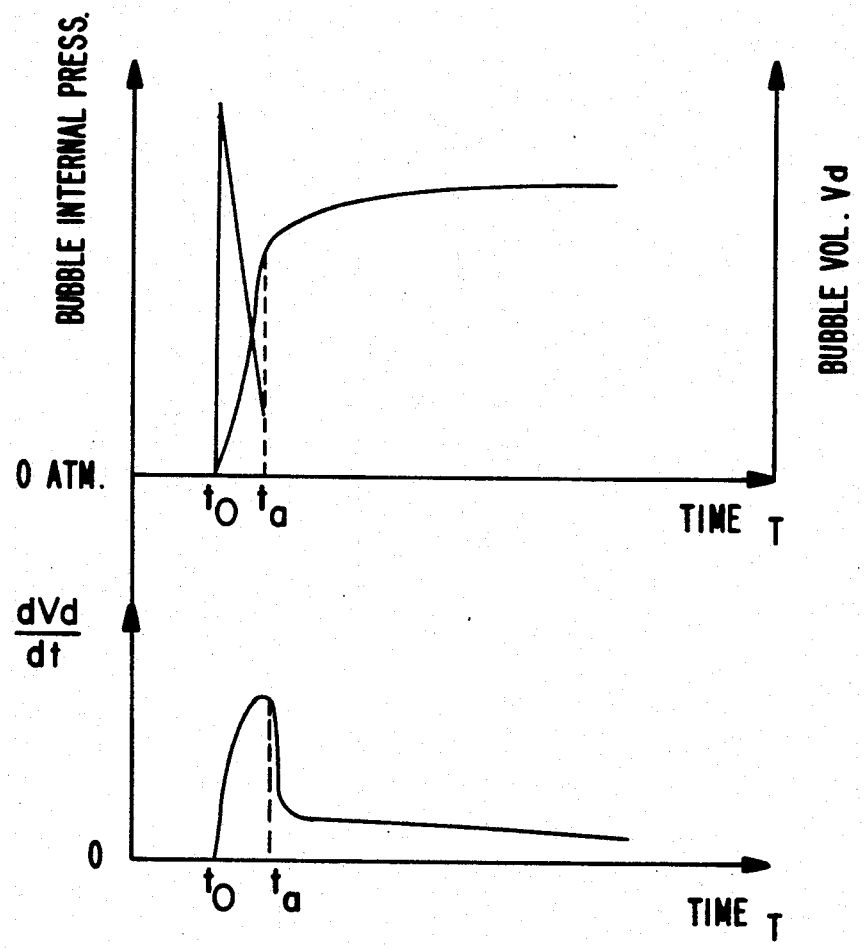
Figure 6E:
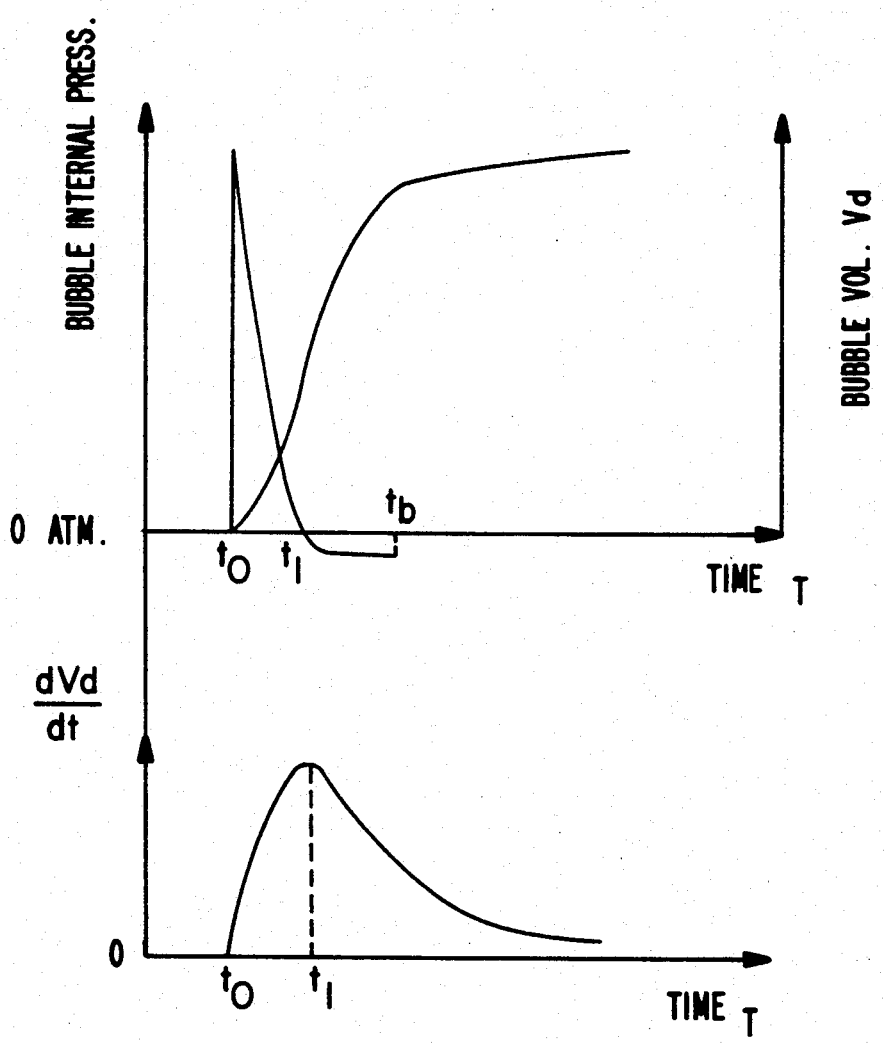
Figure 7A:
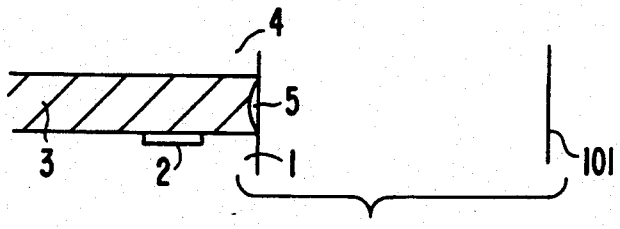
FIGS. 7*a*, 7*b*, 7*c*, 7*d*, 7*e* and 7*f* illustrate the ejection of the liquid in a liquid jet method and apparatus according to another aspect of the present invention.
Figure 7B:
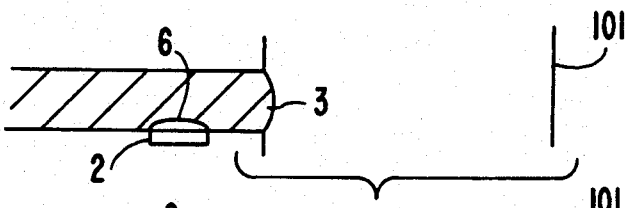
Figure 7C:
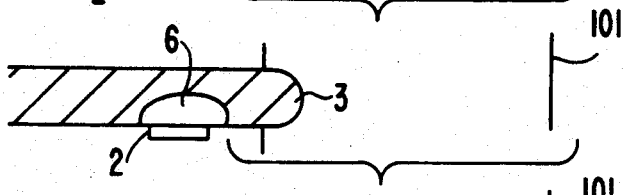
Figure 7D:
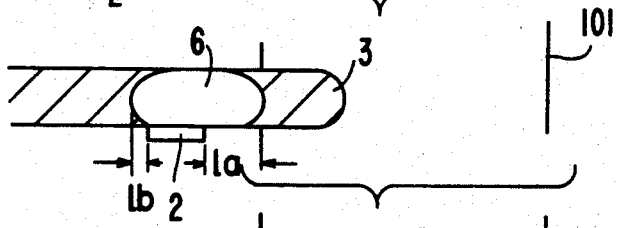
Figure 7E:
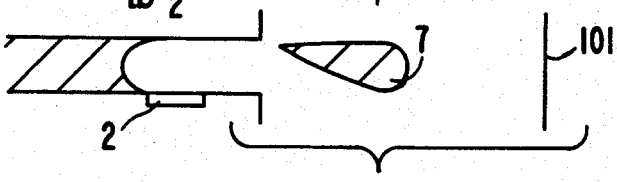
Figure 7F:
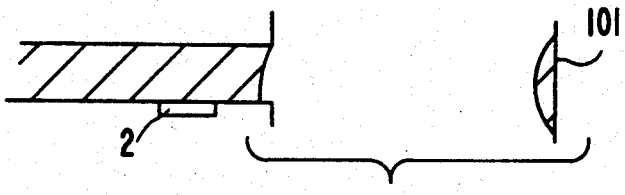

In another method, in the period from the start of the bubble creation to the ejection of the ink, the volume Vd of the ink is measured, and the second order differential $d^2Vd/dt^2$ is obtained. Then, the relation between the internal pressure and the external pressure can be determined. More specifically, if $d^2Vd/dt^2>0$, the internal pressure of the bubble is higher than the external pressure, and if $d^2Vd/dt^2\leqq 0$, the internal pressure is equal to or less than the external pressure. FIG. 6, (*d*) shows the change, with time, of the first order differential dVd/dt of the volume of the ejected ink when the bubble communication occurs with the internal pressure higher than the external pressure. From the start of the bubble creation ($t=t_0$) to the communication of the bubble with the ambience ($t=ta$), the internal pressure of the bubble is higher than the external pressure, and $d^2Vd/dt^2>0$. FIG. 6E shows the change, with time, of the first order-differential dVd/dt of the volume of the ejected ink with when the bubble communication occurs with the internal pressure is being equal to or lower than the external pressure. From the start of the bubble creation ($t=t_0$) to the communication of the bubble with the ambience ($t=t_1$), the internal pressure of the bubble is higher than the external pressure, and $d^2Vd/dt^2=0$. However, in the period from $t=tp$ to $t=t_b$, the bubble internal pressure is equal to or lower than the external pressure, and $d^2Vd/dt^2\leqq 0$.

Thus, on the basis of the second order differential $d^2Vd/dt^2$, it can be determined which is higher, the internal pressure or the external pressure.

The description will be made as to the measurement of the volume Vd of the ink outside the ejection outlet. The configuration of the droplet at any time after the ejection can be determined on the basis of observation, by a microscope, of the ejecting droplet while it is illuminated with a light source such as a stroboscope, LED or laser. The pulse light is emitted to the recording head driven at regular intervals, with synchronization therewith and with a predetermined delay. By doing so, the configuration of the bubble as seen in one direction at the time which is the predetermined period after the ejection, is determined. The pulse width of the pulse light is preferably as small as possible, provided that the quantity of the light is sufficient for the observation, since then the configuration determination is accurate.

With this method, if the gas flow is observed in the external direction from the liquid passage at the instance when the bubble communicates with the ambience, it is understood that the communication occurs when the internal pressure of the bubble is higher than the ambient pressure. If the gas flow into the liquid passage is observed, it is understood that the communication occurs when the bubble internal pressure is lower than the ambient pressure.

Figure 8A:
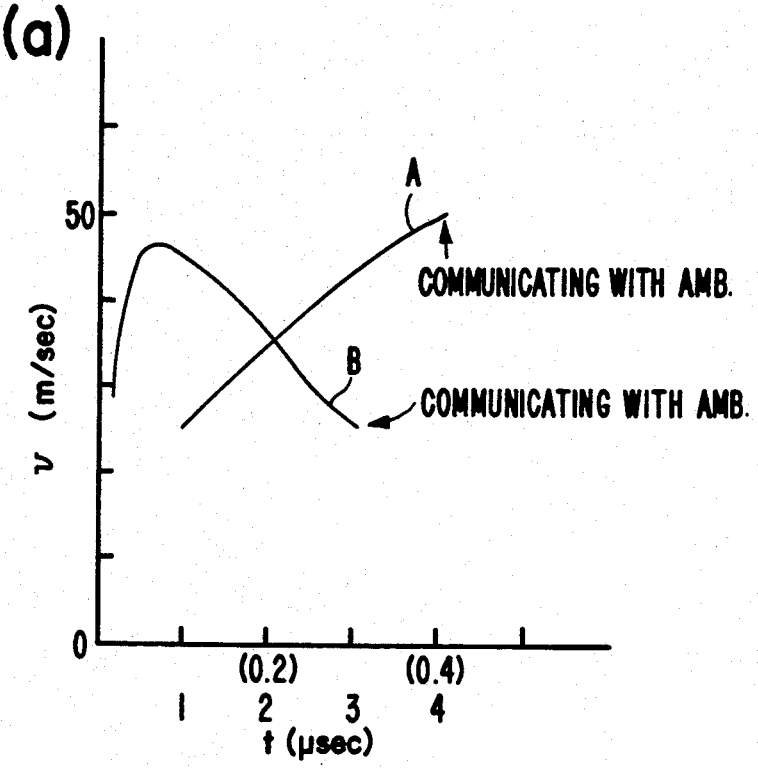
FIGS. 8A and 8B illustrate a liquid jet method and apparatus according to a further aspect of the present invention.
Figure 8B:
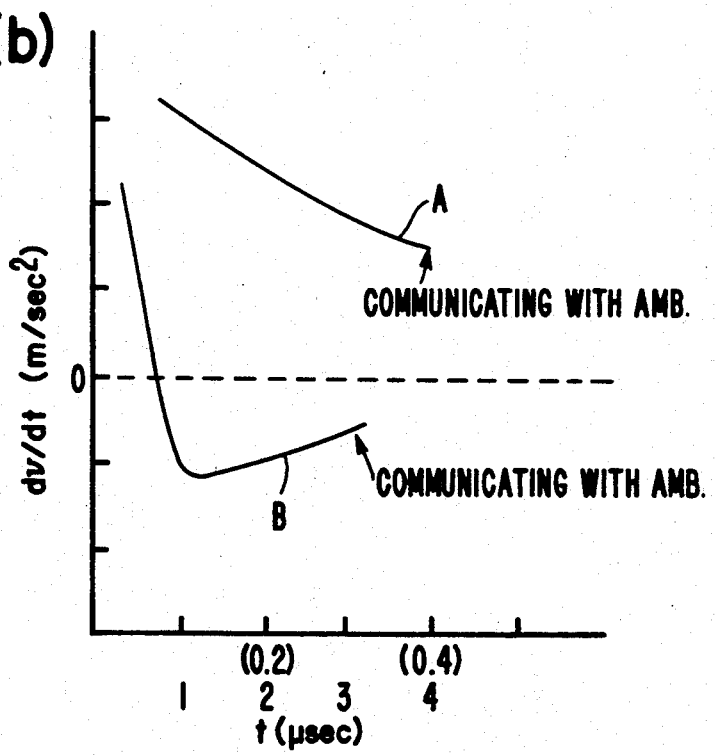

As for other preferable conditions, the bubble communicates with the ambience when the first order differentiation of the movement speed of an ejection outlet side end of the bubble is negative, as shown in FIG. 8; and the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet. It is further preferable that both of the above conditions are satisfied when the bubble communicates with the ambience.

Referring to FIG. 7, there is shown the growth of the bubble in a liquid jet method and apparatus according to a second specific embodiment of the present invention.

The specific embodiment is summarized as follows:

(3) A recording method uses a recording head including an ejection outlet for ejecting ink, a liquid passage communicating with the ejection outlet and an ejection energy generating means for generating thermal energy contributable to ejection of the ink by creation of a bubble in the liquid passage, wherein the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet.

(4) A recording apparatus includes a recording head having an ejection outlet for ejecting ink, a liquid passage communicating with the ejection outlet and ejection energy generating means for generating thermal energy contributable to ejection of the ink by creation of a bubble in the liquid passage, a driving circuit for supplying a signal to said ejection energy generating means so that the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet and a platen for supporting a recording material for reception of the liquid ejected.

FIG. 7, (*a*) shows the initial state in which the passage is filled with ink 3. The heater 2 (electro-thermal transducer, for example) is instantaneously supplied with electric current, the ink adjacent the heater 2 is abruptly heated by the pulse of the current in the form of the driving signal from the driving circuit, upon which a bubble 6 is produced on the heater 2 by the so-called film boiling, and the bubble abruptly expands (FIG. 7(*b*)). The bubble continues to expand toward the ejection outlet 5 (FIG. 7(*c*)), that is, in the direction of low intertia resistance. It further expands beyond the outlet 5 so that it communicates with the ambience (FIG. 7(*d*)). Here, the bubble 6 communicates with the ambience when $l_a/l_b \geqq 1$ is satisfied, where $l_a$ is a distance from an ejection outlet side end of the heater 2 functioning as the ejection energy generating means and an ejection outlet side end of the bubble 6, and $l_b$ is a distance from that end of the heater 2 remote from the ejection outlet and that end of the bubble 6 which is remote from the ejection outlet.

The ink 3 pushed out by the bubble through the outlet 5 moves forward further by the momentum given by the expansion of the bubble, until it becomes an independent droplet and is deposited on a recording material 101 such as paper (FIG. 7(*e*)). The cavity produced adjacent the outlet 5 is supplied with the ink from behind by the surface tension of the ink 3 and by wetting with the member defining the liquid passage, thus restoring the initial state (FIG. 7(*f*)). The recording medium 101 is fed to the position faced to the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required in the relative movement therebetween is to face the outlet to a desired position of the recording material.

If the liquid is ejected in accordance with the principle described above, the volume of the liquid ejected through the ejection outlet is constant at all times, since the bubble communicates with the ambience. When it is used for the recording, a high quality image can be produced without non-uniformity of the image density.

Since the bubble communicates with the ambience under the condition of $l_a/l_b \geqq 1$, the kinetic energy of the bubble can be efficiently transmitted to the ink, so that the ejection efficiency is improved.

Furthermore, when the liquid is ejected under the above-described conditions, the time required for the cavity produced adjacent to the ejection outlet after the liquid is ejected to be filled with new ink, can be reduced as compared with a situation the liquid (ink) is ejected under the condition of $l_a/l_b < 1$, and therefore, the recording speed is further improved.

The description will be made as to the method of measuring the distances $l_a$ and $l_b$ when the bubble communicates with the ambience in the second specific embodiment. For example, in the case of the recording head shown in FIG. 7, the top plate 4 is made of transparent glass plate. The recording head is illuminated from the above by a light source capable of pulsewise light emission such as stroboscope, laser or LED. The recording head is observed through microscope.

More particularly, the pulsewise light source is turned on and off in synchronism with the driving pulses applied to the heater, and the behavior from the creation of the bubble to the ejection of the liquid is observed, using the microscope and camera. Then, the distances $l_a$ and $l_b$ are determined.

The width of the liquid passage is substantially determined by the configuration of the used thermal energy generating element, but it is determined on the basis of rule of thumb. However, it has been found that the configuration of the liquid passage is significantly influential to growth of the bubble, and that it is an effective factor for the above condition of the thermal energy generating element in the passage in the second specific embodiment.

Using the height of the liquid passage, the growth of the bubble may be controlled so as to satisfy $l_a/l_b \geqq 1$, preferably $l_a/l_b \geqq 2$, and further preferably $l_a/l_b \geqq 4$. It has been found that the liquid passage height H is smaller than at least the liquid passage width W ($H<W$), since then the recording operation is less influenced by the ambient condition or another, and therefore, the operation is stabilized. This is because the communication between the bubble and the ambience occurs by the bubble having an increased growing speed in the interface at the ceiling of the liquid passage, so that the influence of the internal wall to the liquid ejection can be reduced, thus further stabilizing the ejection direction and speed. In the second specific embodiment, it has been found that $H \leqq 0.8W$ is preferable since then the ejection performance does not change, and therefore, the ejection is stabilized even if the high speed ejection is effected for a long period of time.

Furthermore, by satisfying $H \leqq 0.65W$, a highly accurate deposition performance can be provided even if the recording ejection is quite largely changed by carrying different recording information.

It is further preferable in addition to the above conditions that the first order differential of the moving speed of the ejection outlet side end of the bubble is negative, when the bubble communicates with the ambience.

Referring to FIG. 8, there is shown the change, with time, of the internal pressure and the volume of the bubble in a liquid jet method and apparatus according to a third specific embodiment of the present invention. The third specific embodiment is summarized as follows:

(5) A liquid jet method uses a recording head having an ejection outlet for ejecting ink, a liquid passage communicating with the ejection outlet and an ejection energy generating element for generating thermal energy contributable to the ejection of the ink by creation of a bubble in the liquid passage, wherein a first order differential of a movement speed of an ejection outlet side end of the created bubble is negative, when the bubble created by the ejection energy generating means communicates with the ambience through the ejection outlet.

(6) A liquid jet apparatus comprising a recording head having an ejection outlet for ejecting ink, a liquid passage communicating with the ejection outlet and an ejection energy generating element for generating thermal energy contributable to the ejection of the ink by creation of a bubble in the liquid passage, a driving circuit for supplying a signal to the ejection energy generating means so that a first order differential of a movement speed of an ejection outlet side end of the created bubble is negative, when the bubble created by the ejection energy generating means communicates with the ambience through the ejection outlet, and a platen for supporting a recording material for reception of the liquid ejected.

The third specific embodiment provides a solution to the problem solved by the first specific embodiment, by a different method. The major problem underlying this third specific embodiment is that the ink existing adjacent the communicating portion between the bubble and the ambience is over-accelerated with the result of the ink existing there being separated from the major part of the ink droplet. If this separation occurs, the ink adjacent thereto is splashed, or is scattered into mist.

In addition, where the ejection outlets are arranged at a high density, improper ejection will occur by the deposition of such ink. The third specific embodiment is based on the finding that the drawbacks are attributable to the acceleration.

More particularly, it has been found that the problems arise when the first order differential of the moving speed of the ejection outlet side end of the bubble is positive when the bubble communicates with the ambience.

FIGS. 8(*a*) and (*b*) are graphs of the first order differential and the second order differential (the first order differential of the moving speed) of the displacement of the ejection outlet side end of the bubble from the ejection outlet side end of the heater until the bubble communicates with the ambience. It will be understood that the above discussed problems arise in the case of a curve A in FIGS. 8(*a*) and (*b*), where the first order differential of the moving speed of the ejection outlet side end of the bubble is positive.

Curves B in FIGS. 8(*a*) and (*b*) represent the third specific embodiment using the concept of FIG. 7. The created bubble communicates with the ambience under the condition of the first order differential of the moving speed of the ejection outlet side end of the bubble. By doing so, the volumes of the liquid droplets are stabilized, so that high quality images can be recorded without ink mist or splash and the resulting paper and apparatus contamination.

Additionally, since the kinetic energy of the bubble can be sufficiently transmitted to the ink, the ejection efficiency is improved so that the clogging of the nozzle can be avoided. The droplet ejection speed is increased, so that the ejection direction can be stabilized, and the required clearance between the recording head and the recording paper can be increased so that the designing of the apparatus is made easier.

The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

As described above, according to the present invention, the non-dimensional number Z is made not less than 0.5 and not more than 16, by which the thermal efficiency is not less than 50% of the maximum efficiency, and therefore, the liquid can be ejected with small input energy.

While the invention has been described with reference to the structures disclosed herein, it is not confined to the details set forth and this application is intended to cover such modifications or changes as may come within the purposes of the improvements or the scope of the following claims.

What is claimed is:

1. A liquid jet recording method comprising the steps of:

heating a liquid in a liquid passage of a recording head;

producing a bubble in the liquid; and expanding the bubble to eject the liquid from the liquid passage, the improvement residing in that a non-dimensional number Z which is determined by the physical nature of the liquid, a heat flux and a configuration of the passage and which is specific to the recording head is not less than 0.5 and not more than 16;where $$Z=(\pi/6)^{\frac{1}{2}}Tgk(P_g/q_0)^{3/2}/(\rho_g Lg\cdot a\cdot S_H A)^{\frac{1}{2}};$$

Tg is a superheat limit temperature of the major component of the liquid;

Pg is a saturated vapor pressure of the major component of the liquid at temperature Tg;

$\rho g$ is a saturated vapor density of the major component of the liquid at temperature Tg;

Lg is a latent heat of vaporization of the major component of the liquid at temperature Tg;

k is a heat conductivity of the major component of the liquid at the temperature of the recording head before heating;

a is a thermal diffusivity of the major component of the liquid at the temperature of the recording head before heating;

$q_0$ is a flux of the heat which heats the liquid;

$S_H$ is an area of that part (heating surface of the heat generating element) which heats the liquid;

A is an inertance of the passage under the conditions that the heating surface is a pressure source, that the liquid supply opening and the liquid ejection opening are open boundaries, and that the wall defining the passage is a fixed boundary; and $\pi$ is the number $\pi$; whereby said heating is produced with good thermal efficiency.

2. A method according to claim 1, wherein a plurality of such passages are provided in the recording head.

3. A method according to claim 1, further comprising the step of supplying electric signals for producing film boiling to create the bubble.

4. A recording apparatus comprising:

a recording head having an ejection outlet and ejection energy generating means;

a driving circuit for driving the ejection energy generating means; and a liquid disposed in said recording head for being discharged by a bubble produced by heating with said ejection energy generating means, the liquid including a major component, wherein a non-dimensional number Z which is determined by the physical nature of the liquid, a heat flux and a configuration of the passage and which is specific to a recording head is not less than 0.5 and not more than 16; where $$Z=(\pi/6)^{\frac{1}{2}}Tgk(P_g/q_0)^{3/2}/(\rho_g Lg\cdot a\cdot S_H A)^{\frac{1}{2}};$$

Tg is a superheat limit temperature of the major component of the liquid;

Pg is a saturated vapor pressure of the major component of the liquid at temperature Tg;

$\rho g$ is a saturated vapor density of the major component of the liquid at temperature Tg;

Lg is a latent heat of vaporization of the major component of the liquid at temperature Tg;

k is a heat conductivity of the major component of the liquid at the temperature of the recording head before heating;

a is a thermal diffusivity of the major component of the liquid at the temperature of the recording head before heating;

$q_0$ is a flux of the heat which heats the liquid;

$S_H$ is an area of that part (heating surface of the heat generating element) which heats the liquid;

A is an inertance of the passage under the conditions that the heating surface is a pressure source, that the liquid supply opening and the liquid ejection opening are open boundaries, and that the wall defining the passage is a fixed boundary; and $\pi$ is the number $\pi$, whereby said heating is produced with good thermal efficiency.

5. An apparatus according to claim 4, wherein a plurality of said passages are provided.

6. An apparatus according to claim 4, further comprising means for supplying electric signals for producing film boiling to create the bubble.

* * * * *

UNITED STATES PATENT AND TRADEMARK OFFICE

CERTIFICATE OF CORRECTION

PATENT NO. : 5,218,376 Page 1 of 2

DATED : June 8, 1993

INVENTOR(S) : Akira Asai

It is certified that error appears in the above-indentified patent and that said Letters Patent is hereby corrected as shown below:

COLUMN 6:

Line 60, "$dp_v/dTv=Lv/Tv(1\rho_v-1/\rho_1)$ (19)"

should read --$dp_v/dTv=Lv/Tv(1/\rho_v-1/\rho_1)$ (19)--.

COLUMN 7:

Line 65, "= $(\pi/6)^{1/2}Tgk(p_g/p_0)^{3/2}\cdot 1/(\rho_g Lg\cdot a\cdot S_H A)^{1/2}$"

should read --= $(\pi/6)^{1/2}Tgk(p_g/q_0)^{3/2}\cdot 1/(\rho_g Lg\cdot a\cdot S_H A)^{1/2}$--.

COLUMN 8:

Line 25, "Tg≈600 K.," should read --Tg≈600K,--.

COLUMN 13:

Line 66, "outlet" should read --outlet,--.

COLUMN 17:

Line 60, "16;where" should read --16; where--.

UNITED STATES PATENT AND TRADEMARK OFFICE

CERTIFICATE OF CORRECTION

PATENT NO. : 5,218,376

DATED : June 8, 1993

INVENTOR(S) : Akira Asai

It is certified that error appears in the above-indentified patent and that said Letters Patent is hereby corrected as shown below:

COLUMN 18:

Line 17, "$\pi$;" should read --$\pi$,--.

Signed and Sealed this

Nineteenth Day of April, 1994

Bruce Lehman

*Attest:*

BRUCE LEHMAN

*Attesting Officer*

*Commissioner of Patents and Trademarks*